US005167212A

United States Patent [19]

Peter et al.

[11] Patent Number: 5,167,212

[45] Date of Patent: Dec. 1, 1992

[54] MONITORING DEVICE FOR THE POSITION REGULATOR IN AN ELECTRONIC ACCELERATOR PEDAL

[75] Inventors: Cornelius Peter, Ottersweiher; Karl-Heinrich Preis, Bühlertal, both of Fed. Rep. of Germany

[73] Assignee: Robert Bosch GmbH, Stuttgart, Fed. Rep. of Germany

[21] Appl. No.: 466,346

[22] PCT Filed: Jul. 8, 1988

[86] PCT No.: PCT/EP88/00611

§ 371 Date: Mar. 8, 1990

§ 102(e) Date: Mar. 8, 1990

[87] PCT Pub. No.: WO90/00678

PCT Pub. Date: Jan. 25, 1990

[51] Int. Cl.[5] ..... F02D 9/08

[52] U.S. Cl. ..... 123/399

[58] Field of Search ..... 123/352, 361, 399

[56] References Cited

U.S. PATENT DOCUMENTS 4,353,339 10/1982 Collonia ..... 123/399 X
4,419,973 12/1983 Collonia ..... 123/399 X
4,508,078 4/1985 Takeuchi et al. ..... 123/399
4,603,675 8/1986 Junginger et al. ..... 123/478
4,622,936 11/1986 Junginger et al. ..... 123/399
4,901,695 2/1990 Kabasin et al. ..... 123/399
5,016,588 5/1991 Pagdin et al. ..... 123/399

*Primary Examiner*—Willis R. Wolfe
*Attorney, Agent, or Firm*—Walter Ottesen

[57] ABSTRACT

A monitoring device for an electronic accelerator pedal (1) in a motor vehicle has an accelerator pedal position sensor (2) mechanically connected to the accelerator pedal (1), a butterfly valve (7), a servo-motor (5) for the butterfly valve (7) and a butterfly valve position sensor (6) mechanically connected thereto. A regulator (3) receives a desired value (αD) from the accelerator pedal position sensor (2) and an actual value (αA) from the butterfly valve position sensor (6) and controls an output stage (4) for the servo-motor (5) in response to the comparison. A subtractor (14) in a slave circuit (12) forms the difference (αE) between the desired (αD) and actual (αA) values of the butterfly valve opening angle. An integrator (16) integrates the control difference (αE) and is re-set to zero when the control difference (αE) is zero or changes sign, whereupon integration of the control difference (αE) is resumed. A limit device (18) indicates to a master circuit (10)the presence of a fault condition when the integrator output exceeds a predetermined limiting value.

4 Claims, 2 Drawing Sheets

MONITORING DEVICE FOR THE POSITION REGULATOR IN AN ELECTRONIC ACCELERATOR PEDAL

FIELD OF THE INVENTION

The invention relates to a monitoring device for an electronic accelerator pedal in a motor vehicle.

BACKGROUND OF THE INVENTION

A protective and monitoring device for an electronic accelerator pedal in motor vehicles is also already known from U.S. Pat. No. 4,603,675. In the latter device, an accelerator pedal-position sensor in the form of a potentiometer is connected to the accelerator pedal and supplies a desired value to a first regulator which receives an actual value from a potentiometer connected to the butterfly valve so that the first regulator forms a control difference and hence drives the servomotor of the butterfly valve by way of an output stage. The traditional mechanical adjustment of the butterfly valve is implemented electroncally in this manner. In accordance with U.S. Pat. No. 4,603,675, a control difference is formed by subtraction of the actual value from the desired value and is applied to a second regulator to form a variable quantity filtered from the dynamic behavior of the control loop. A window comparator detects whenever this variable quantity lies outside desired limits and can activate a fault warning device accordingly.

SUMMARY OF THE INVENTION

The present invention seeks to improve on the latter arrangement.

A monitoring device in accordance with the present invention includes an accelerator pedal position sensor mechanically connected to the pedal, a servomotor for a butterfly valve of the motor vehicle and a butterfly valve position sensor mechanically connected to the butterfly valve. A regulator is provided which receives a desired value from the accelerator pedal position sensor and an actual value from the butterfly valve position sensor and controls an output stage for the servomotor. The monitoring device also includes a subtractor in a slave circuit which forms the difference ($\alpha E$) between the desired ($\alpha D$) and actual ($\alpha A$) values of the butterfly valve opening angle. An integrator integrates the control difference ($\alpha E$) and is reset to zero when the control difference is zero or changes sign whereupon integration of the control difference ($\alpha E$) is resumed. A limit device indicates to a master circuit the presence of a fault condition when the integrator output exceeds a predetermined limiting value.

The monitor device of the invention affords the advantage that it monitors the basic control loop of the position regulator in a slave circuit and provides a check for the presence of a permanent control error.

BRIEF DESCRIPTION OF THE DRAWINGS

The invention is described further hereinafter, by way of example only, with reference to the accompanying drawings, wherein.

DESCRIPTION OF THE PREFERRED EMBODIMENTS OF THE INVENTION

Figure 1:
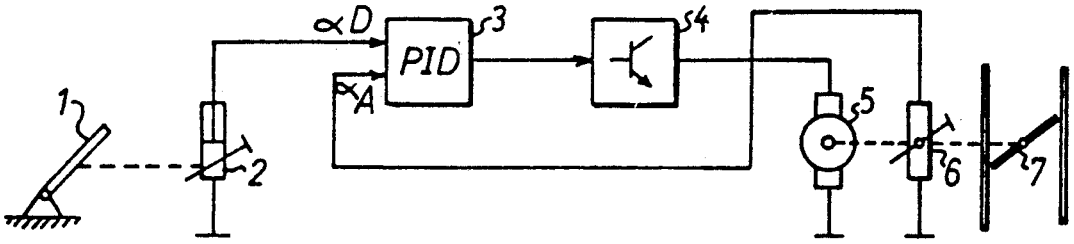
FIG. 1 shows a basic known electronically controlled butterfly valve.

Referring first to the known arrangement of FIG. 1, an accelerator pedal 1 is mechanically connected to an accelerator pedal position sensor 2 in the form of a potentiometer whose resistance is proportional to the adjusted angle of the accelerator pedal 1. Hence, the resistance of the accelerator pedal position sensor 2 constitutes a desired value $\alpha D$ for a regulator 3 which is connected to the accelerator pedal position sensor 2. The regulator 3 controls an output stage 4 for a servomotor 5 of a butterfly valve 7 of a motor vehicle. The servo-motor 5 is mechanically connected to the butterfly valve 7 and to a butterfly valve position sensor 6 which, like the accelerator pedal position sensor 2, is a potentiometer, so that the resistance of the butterfly valve position sensor 6 supplies the regulator 3 with an actual value $\alpha A$ of the position of the butterfly valve 7. A control loop, known to one skilled in the art, and not further described in order to simplify the drawing, is thereby closed. The regulator 3 shown in FIG. 1 is a PID regulator which controls the output stage 4 in dependence upon an analog control difference. However, the known monitoring device may also function with other types of regulators, such as switching regulators which only take the sign of the control difference into account, provided that the transient response of the closed control loop exhibits a diminishing control difference. Hence, the present invention is not limited only to the embodiment of a butterfly position control shown in FIG. 1.

Figure 2:
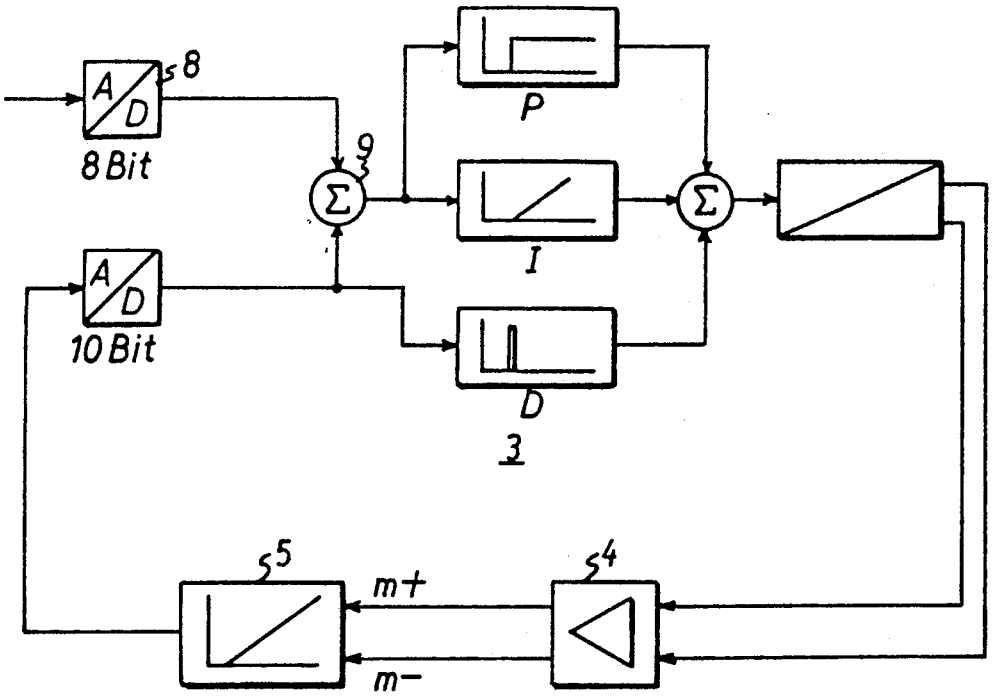
FIG. 2 shows a digital version of the basic arrangement of FIG. 1.

FIG. 2 shows the known system of FIG. 1 in digital form, similar parts being given the same reference numerals. In the digital system of FIG. 2, the analog signal from the pedal transducer 2 is converted at 8 into an 8-bit digital signal which is applied to an adding element 9 of the PID regulator 3. The PID regulator is chosen to have a scanning time in the order of 5 ms. The PID regulator 3 supplies, via the output stage 4, polarized output signals $M+M-$ to control the direction of operation of the servomotor 5. The butterfly valve position sensor 6 (not shown in FIG. 2) supplies a feedback signal representative of the actual butterfly valve position, the latter signal being converted into a 10-bit digital signal for processing by the regulator 3.

Figure 3:
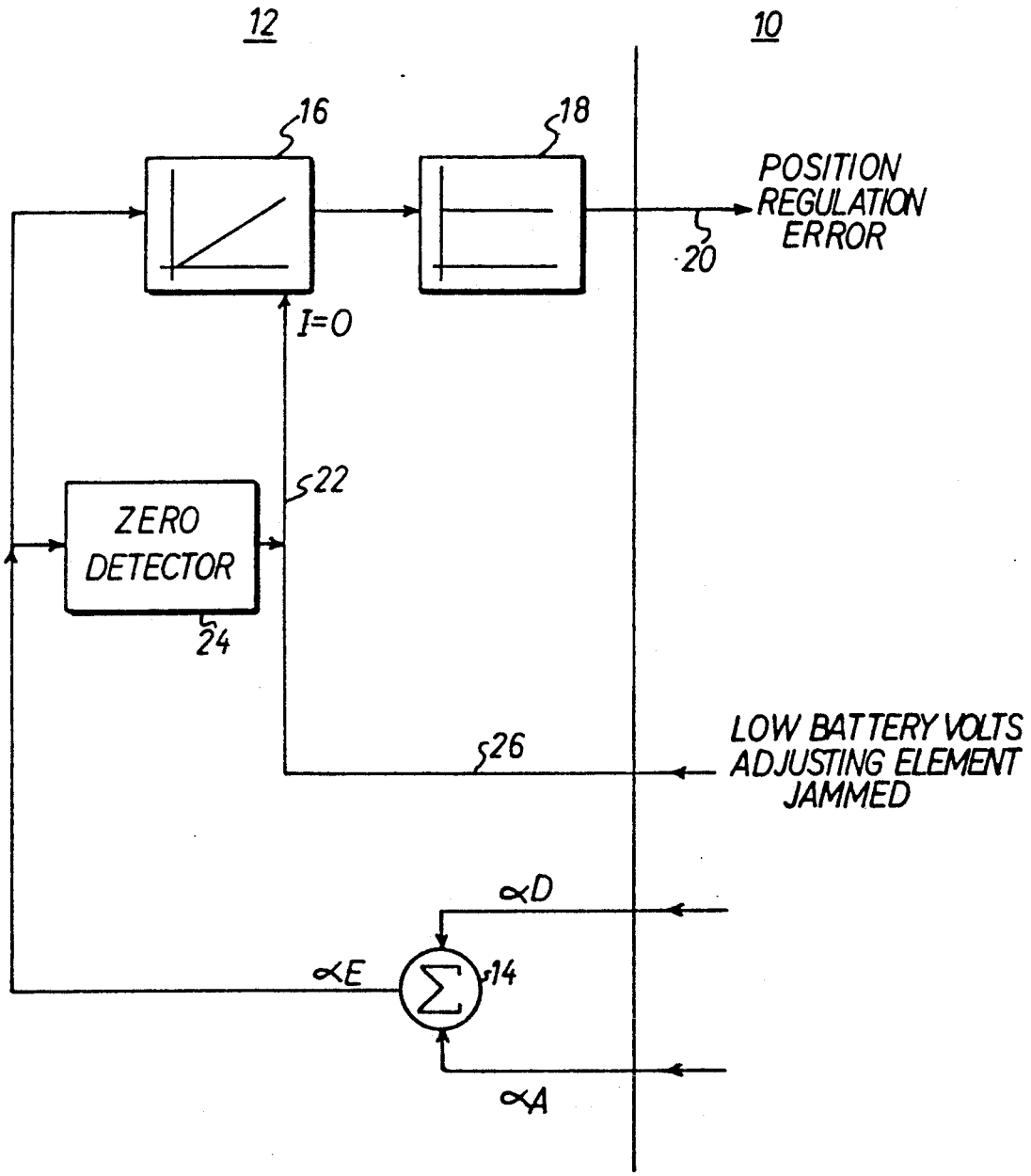
FIG. 3 shows how the basic arrangements of FIG. 1 or 2 may be modified in accordance with the present invention.

Referring now to FIG. 3, in the arrangement according to the present invention, the operating state of the basic master control circuit 10 of FIG. 1 or FIG. 2 is monitored in a slave circuit 12 in order to check for the existence of permanent control errors.

A permanent control error will exist in the presence of any one or more of the following fault conditions, namely:

(a) the basic control is interrupted;

(b) there is no integral proportion in the regulator 3;

(c) the regulating element, that is the motor 5, butterfly valve 7 or position sensing element, jams;

(d) the battery voltage is too low.

The master circuit 10 makes available to the slave circuit 12 signals $\alpha D$ and $\alpha A$ (analog or digital) corresponding to the desired and actual values of the butterfly valve angle and the difference $\alpha E$ between them is established in a subtractor element 14. An integrator 16 in the slave circuit 12 integrates the difference $\alpha E$ between the desired and actual value. The output of the integrator is connected to a limit detector 18 such that an error condition is considered to have been established if the output of the integrator exceeds a predetermined limiting value. In this event, an "error present" signal is returned to the master circuit 10 via a line 20.

The integrator 16 is arranged to be re-set via a line 22 by means of a zero detector 24 which outputs an integrator re-set signal in the event that the difference signal $\alpha E$ is zero and in the event also that there is a change of sign between the desired and actual values whereby a zero-crossing occurs.

In the event that the regulating element should become jammed in the forward direction, the system should not detect an error, since jamming may be due to freezing up. This error will therefore be eliminated automatically when the engine warms up. To prevent the system from detecting a fault condition in these circumstances, therefore, an "adjusting element jammed" signal is arranged to be generated in the master circuit 10 and applied via a line 26 to the integrator re-set line 22 so as to re-set the integrator to zero.

Furthermore, on starting the motor vehicle, voltage drops may occur in the battery output so that the butterfly valve is unable to move into the desired position. If this were to be detected by the system as an error, then it would not be possible to properly start the motor vehicle in the event of low battery voltage. Thus, a "low battery voltage" signal is generated in the master circuit 10 and is again applied via the line 26 to re-set the integrator to zero.

Thus, lower battery voltage and the adjusting element being jammed are tolerated by the system without triggering an error condition in order to obtain better availability.

We claim:

1. A monitoring device for an electronic accelerator pedal in a motor vehicle having a butterfly valve, the monitoring device comprising:

a master control circuit including:

an accelerator pedal position sensor mechanically connected to the accelerator pedal for supplying a desired pedal position signal ($\alpha D$);

a servomotor operatively connected to the butterfly valve for adjusting the position of said valve;

an output stage for driving said servomotor;

a butterfly valve position sensor mechanically connected to said valve for supplying an actual position signal ($\alpha A$);

regulator means for controlling said output stage as a function of said signals;

a slave circuit including:

a subtractor for receiving said signals ($\alpha A$, $\alpha D$) and forming a control difference signal ($\alpha E$) therefrom;

an integrator for integrating said control difference signal ($\alpha E$) and supplying an integrator output signal;

reset means for resetting said integrator to zero when said control difference ($\alpha E$) is zero or changes sign thereby causing integration of said control difference signal ($\alpha E$) to resume; and, limit means for receiving said integrator output signal and issuing an error present signal to said master control circuit when said integrator output signal exceeds a predetermined limiting value.

2. The monitoring device of claim 1, said reset means including: a zero detector connected to the output of said subtractor for receiving said control difference signal ($\alpha E$) and for supplying a reset signal when said control difference signal ($\alpha E$) is zero or changes sign; and, a line connecting said zero detector to said integrator for conducting said reset signal to said integrator.

3. The monitoring device of claim 2, further comprising means for applying a signal to said line for resetting the integrator to zero in the event that the battery voltage of the motor vehicle battery lies below a predetermined level.

4. The monitoring device of claim 2, further comprising means for applying a signal to said line for resetting the integrator to zero in the event that the butterfly valve or said butterfly valve position sensor should jam.

* * * * *